US005549302A

United States Patent [19]

Lapsker et al.

[11] Patent Number: 5,549,302

[45] Date of Patent: Aug. 27, 1996

[54] ATHLETIC PROJECTILE AND TARGET TRAINING DEVICE

[76] Inventors: Irving Lapsker, P.O. Box 31624, Palm Beach Gardens, Fla. 33410; Jeffry G. Lapsker, 18 Honey La.; Conrad Jaroszewski, 430 Essex La., both of New Lenox, Ill. 60451

[21] Appl. No.: 491,065

[22] Filed: Jun. 16, 1995

[51] Int. Cl.[6] ..... A63B 63/00; A63B 67/00; F41J 1/00

[52] U.S. Cl. ..... 273/346; 273/DIG. 30

[58] Field of Search ..... 273/346, 407, 273/26 A, 181 R, 181 B, 181 K, 57.2, 394, 395, 396, 424, 425, 400, DIG. 30

[56] References Cited

U.S. PATENT DOCUMENTS

| | | | |
|---|---|---|---|
| 3,601,406 | 8/1971 | Giusti | 273/176 F |
| 3,856,298 | 12/1974 | Frantti | 273/57.2 |
| 3,941,383 | 3/1976 | Clarke | 273/346 |
| 4,049,271 | 9/1977 | Fonti | 273/346 |
| 4,415,154 | 11/1983 | Engelhardt | 273/26 A |
| 4,863,176 | 9/1989 | Lapkewych | 273/346 |
| 5,120,055 | 6/1992 | McCarthy et al. | 273/57.2 |
| 5,161,799 | 11/1992 | Nandra | 273/57.2 |
| 5,344,155 | 9/1994 | Huang | 273/346 |
| 5,358,742 | 10/1994 | Ziff | 273/346 X |
| 5,431,411 | 7/1995 | Padilla | 273/400 |

FOREIGN PATENT DOCUMENTS

| | | | |
|---|---|---|---|
| 1489655 | 10/1977 | United Kingdom | 273/346 |
| 1489751 | 10/1977 | United Kingdom | 273/346 |

OTHER PUBLICATIONS

Super Star Sports Games Advertisement. Playthings Magazine, Feb. 1977.

*Primary Examiner*—William H. Grieb
*Attorney, Agent, or Firm*—Richard C. Litman

[57] ABSTRACT

A device for allowing an athlete to practice various methods of propelling a projectile in a controlled and accurate manner by allowing him/her to place the projectile on a specific location on a target. This device uses hook and loop fastening material on the projectile and the target to allow the athlete to know where the projectile strikes the target and allow him/her to practice various ways of getting the projectile onto the target. The reversible nature of the target allows the athlete to practice different sports using the same apparatus or to practice skills required in different situations encountered in the same sport.

16 Claims, 5 Drawing Sheets

FIG. 2
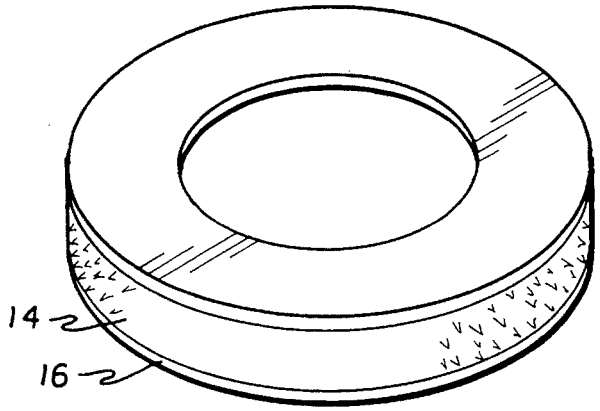
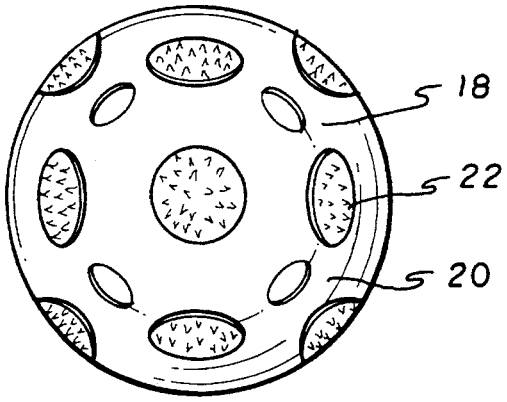
FIG. 3
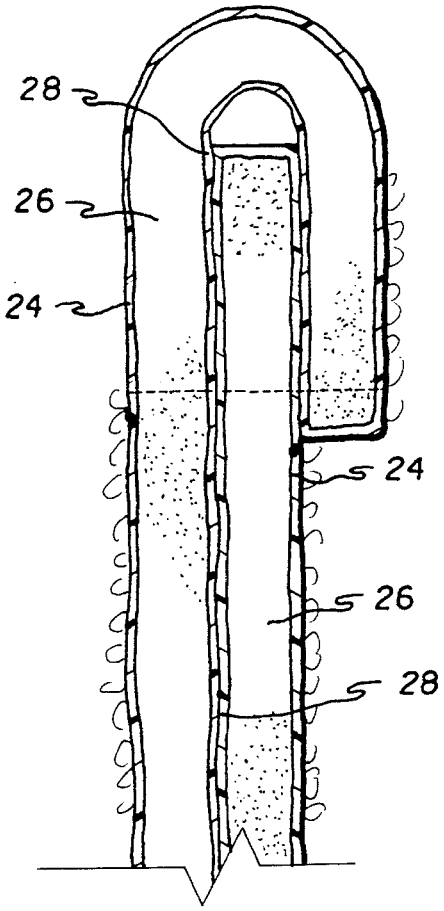
FIG. 7

ATHLETIC PROJECTILE AND TARGET TRAINING DEVICE

BACKGROUND OF THE INVENTION

1. Field of the Invention

The present invention relates to an apparatus for practicing sporting skills, specifically, those skills which require the ability to control a projectile with a club or stick, such as a golf club, hockey stick, tennis racket, baseball bat or lacrosse stick.

2. Description of the Prior Art

Practice devices for sports which require the use of sticks and projectiles utilizing hook and loop fastening means are generally known in the prior art. U.S. Pat. No. 3,601,406, issued to Aldo J. Giusti, on Aug. 24, 1971, discloses a golf practicing apparatus in which some portions of the target panel are constructed of a loop material which is capable of receiving the hook fastening material attached to the ball. The golf practicing apparatus is supported by hooks mounted on a wall.

U.S. Pat. No. 3,941,383, issued to William A. Clarke, on Mar. 2, 1976, reveals a projectile game comprising a hook fastening projectile and loop fastening target. The projectile is described as two wheel elements joined together at right angles to form a ball and having hook fastening material attached to the outer circumference of the wheel which is thrown at a target having a single face of loop fastening material. In the alternative a single wheel can be tossed, flying saucer style, at the target. The hook fastening material being attached to the circumference of each wheel element. The target is supported by hooks mounted on a wall.

U.S. Pat. No. 5,344,155, issued to Jung-Feng Huang, on Sep. 6, 1994, shows a hook and loop fastening ball and target device. A ball having hook fastening material covering the entire outer surface area of the ball is thrown against the target which has a single face of loop fastening material. The ball is thrown at a bulls eye pattern imprinted on the target. The target is hung from a frame which has a net to contain balls which are thrown and do not hit the target.

U.S. Pat. No. 5,358,742, issued to Irving Ziff on Oct. 25, 1994, discloses a hook and loop fastening ball and target game. The game is played by throwing a loop/pile covered ball at a target having a single face of hook fastening material. The target is supported by an angled frame which is designed for use on the ground or floated in the water.

Existing prior art relating to the use of hook and loop fastening materials are also described in foreign patent literature. Of particular note are the British patents 1,489,751 by Manfred Bock, Heinrich Weber and Giesela Weber, and 1,489,655 by Chan Kwok Leung which discloses various means of attaching a hook fastening material to the outer surface of a projectile ball for a ball game. The game is played by throwing the projectile ball at a target having patches of loop fastening material.

Practice devices for hockey which allow the athlete to practice his skills in controlling a hockey puck with a hockey stick also known in the prior art. U.S. Pat. No. 5,161,799, issue to Mukhtar S. Nandra on Nov. 10, 1992 reveals a hockey practice apparatus kit which utilizes a hockey puck affixed to a track to allow the athlete to practice his shot styles. Also, U.S. Pat. No. 5,120,055, issued to McCarthy et al. on Jun. 9, 1992 shows a hockey puck attached to a hockey stick via an elastic cord so as to enable an athlete to practice his puck handling and shooting skills.

None of the above inventions and patents, taken either singly or in combination, is seen to describe a hook and loop fastening practice device with a reversible target which enables an athlete to practice his shooting styles and accuracy as disclosed and claimed in the instant invention.

SUMMARY OF THE INVENTION

Sporting skills require the devotion of a great deal of time, energy and practice to develop fully. Most sports are played using sporting sticks and projectiles designed specifically for that game. Examples of sporting sticks include hockey sticks, golf clubs, baseball bats, tennis rackets, lacrosse sticks, etc. Examples of projectiles are hockey pucks, golf balls, baseballs, tennis balls, lacrosse balls, etc. In order to master the game or sport, a person must master the skill of accurately aiming the projectile towards a desired area or a specific location in a goal. In essence, to win the game, an athlete must be able to control the projectile, and be able to place it within a goal or target, but in order to control the projectile, the athlete must be able to control his/her stick. To achieve this level of skill, many professional athletes begin training at a very young age, so that their control abilities can gradually mature over time.

For an athlete of any skill level, it is difficult to obtain sufficient practice time in a game situation to consistently place the projectile in the appropriate location to score because of the logistical problems of getting a number of players together at the desired times and for the long durations required to properly develop the necessary skills. Therefore, the present invention has been developed to allow individual players to practice the necessary skills on their own.

This device is designed to allow an athlete to practice various methods of propelling a projectile in a given direction or placing the projectile on a specific location on a target. This device uses hook and loop fastening material on the projectile and the target to allow the athlete to know where the projectile strikes the target and allow him/her to practice various ways of getting the projectile on to the target.

An object of this invention is to provide an apparatus for developing sporting skills that requires the use of controlling a projectile with a sports stick.

A further object of this invention is to provide an apparatus for practicing sporting skills that can be used in a variety of different locations. This apparatus is designed to find use in any environment, including a home, an office, a gymnasium, a park, field, or a parking lot.

Another object of this invention is to provide an apparatus for developing sporting skills that may be used by athletes of all skill levels, ranging from novice athletes who have trouble making the projectile hit the target to professionals who are honing their skills or developing a new shooting style.

Yet another object of this invention is to provide an athlete a means of practicing several different sports through the same apparatus. The reversible nature of the target allows the athlete to develop skills for both hockey and golf or golf and baseball, by the same method.

Still another object of this invention is to provide hockey players with the ability to practice various shooting techniques, such as a slap shot, a backhand shot, or a wrist shot.

An additional object of this invention is to provide hockey players with a means to develop the accuracy of the various shooting methods, by allowing the athlete to know where his/her shot will strike the target. Thus the athlete may be able to consistently place a shot in a hard to defend corner of the target or between the legs of a possible defender.

Another object of this invention is to allow a single hockey player to practice shooting a puck at a goal without the need for a person defending the goal and without having to continuously remove the puck from inside a hockey goal netting.

An even further object of this invention is to allow golfers a means to practice various golf swings, such as teeing off and chip shots, with different golf clubs.

These and other objects of the present invention will become readily apparent upon further review of the following specification and drawings.

BRIEF DESCRIPTION OF THE DRAWINGS

FIG. 2 is a perspective view of the disc shaped projectile of the present invention.

FIG. 3 is a perspective view of the ball projectile of the present invention.

FIG. 7 is a cross sectional view of a portion of the target of the present invention, drawn to an enlarged scale.

DETAILED DESCRIPTION OF THE PREFERRED EMBODIMENTS

Figure 1:
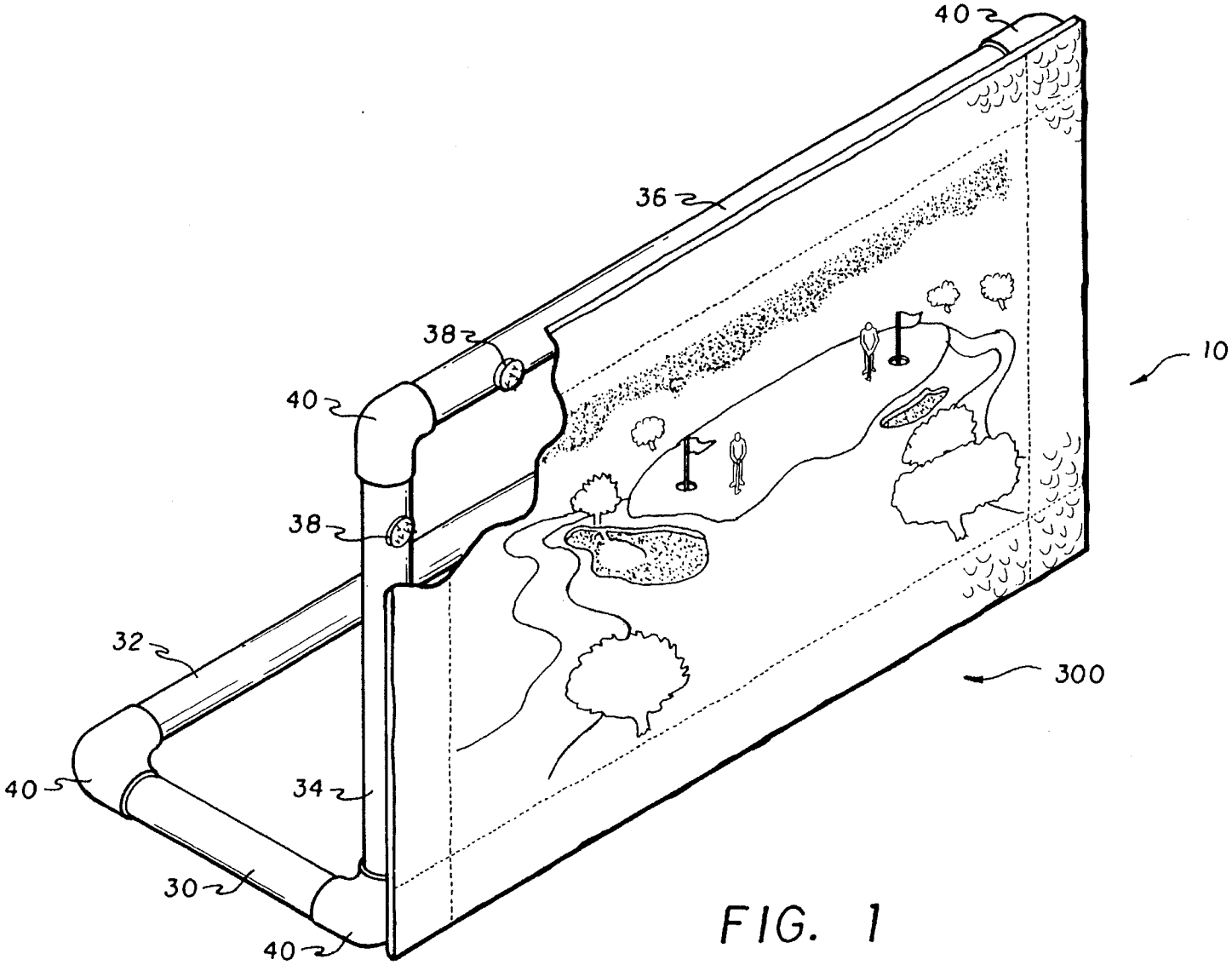
FIG. 1 is a perspective view of the present invention, showing the target attached to the frame.

As shown in FIG. 1, the invention presents a new and improved apparatus for practicing sporting skills that require an athlete to control a projectile with a stick which includes: either a target or a reversible target 10, a plurality of projectiles, and a frame 12 to support the target.

The projectile may take the form of a hockey puck as shown in FIG. 2. The puck may be made of a light weight plastic which has hook fastening material 14 adhered to the circumference of the puck 16. The hook fastening material is such that it will cling to the loop fastening material of the reversible target. The disk with its hook material 14 will attach itself to the reversible target when the puck strikes the reversible target. The puck will also cling to the target when the flat circular face of the puck strikes the target because the flexible nature of the target will allow the hook fastening material near the edges of the puck to attach itself to the loop fastening material of the reversible target. The light weight nature of the puck will allow it to cling to the target, even after the impact of subsequent pucks striking the target. Thus the athlete will be able to place several pucks on the target one right after the other.

The projectile may take the form of a golf ball or baseball depending on the size of the spherical projectile as shown in FIG. 3. The projectile may be constructed of light weight plastic in the form of a hollow spherical ball. This ball is constructed with symmetrically placed holes 18 on the surface of the ball 20 and with a plurality of circular patches 22 of hook fastening material adhered to the outer surface 20. The light weight nature of the hollow balls will allow them to remain attached to the target, even after the impact of subsequent balls striking the target. Thus the athlete will be able to place several balls on the target sequentially.

The target may be made using either single sheets of loop fastening material, having an area that covers an entire side of the target, or using multiple strips of loop fastening material. The loop fastening material includes loops of nylon cord projecting from a supporting fabric sheet. Most preferably, the reversible target is constructed of two panels, each having a sports related design on its front, sewn together back-to-back as shown in FIG. 7. Each panel is constructed of three layers consisting of a 100% nylon loop fastening material 24, a polyester foam core 26, and a back panel of nylon tricot 28. One panel is slightly larger than the second, so that the excess material from the larger panel may be folded over the edges of the second panel, such that the two panels can be sewn together. The preferred target is constructed of a single panel whose edges are folded over and hemmed so as to expose the nylon loop fastening material 24 on the edges of the back side of the target.

The desired sports theme or design is imprinted on the loop fastening material 24, in a manner that does not impede the loop fastening function of the material 24. Examples of methods of imprinting designs onto the target without impeding the loop fastening functions of the loop fastening material include embroidering the design into the sheets 24, directly weaving the design into the supporting fabric of sheets 24, applying the ink to the back of sheets 24 so that the ink seeps through the supporting fabric rendering the design visible from the loop fastener side of sheets 24, screen printing the design to the front of sheet 24 or by any means in which the design is applied so as to preserve the loop fastening function of the sheets 24.

Figure 4:
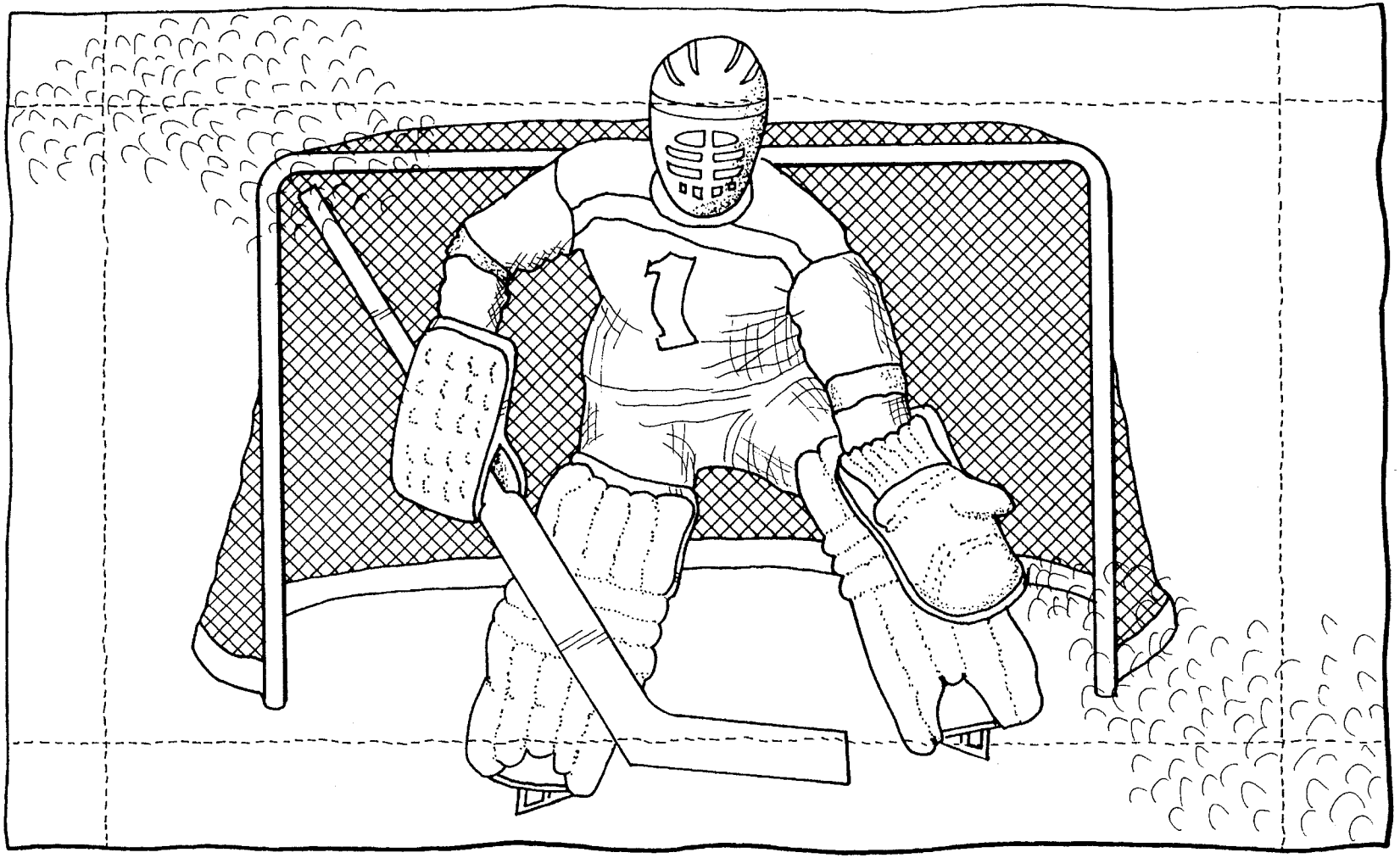
FIG. 4 is a front view of the target of the present invention, showing a hockey design imprinted on the target.
Figure 5:
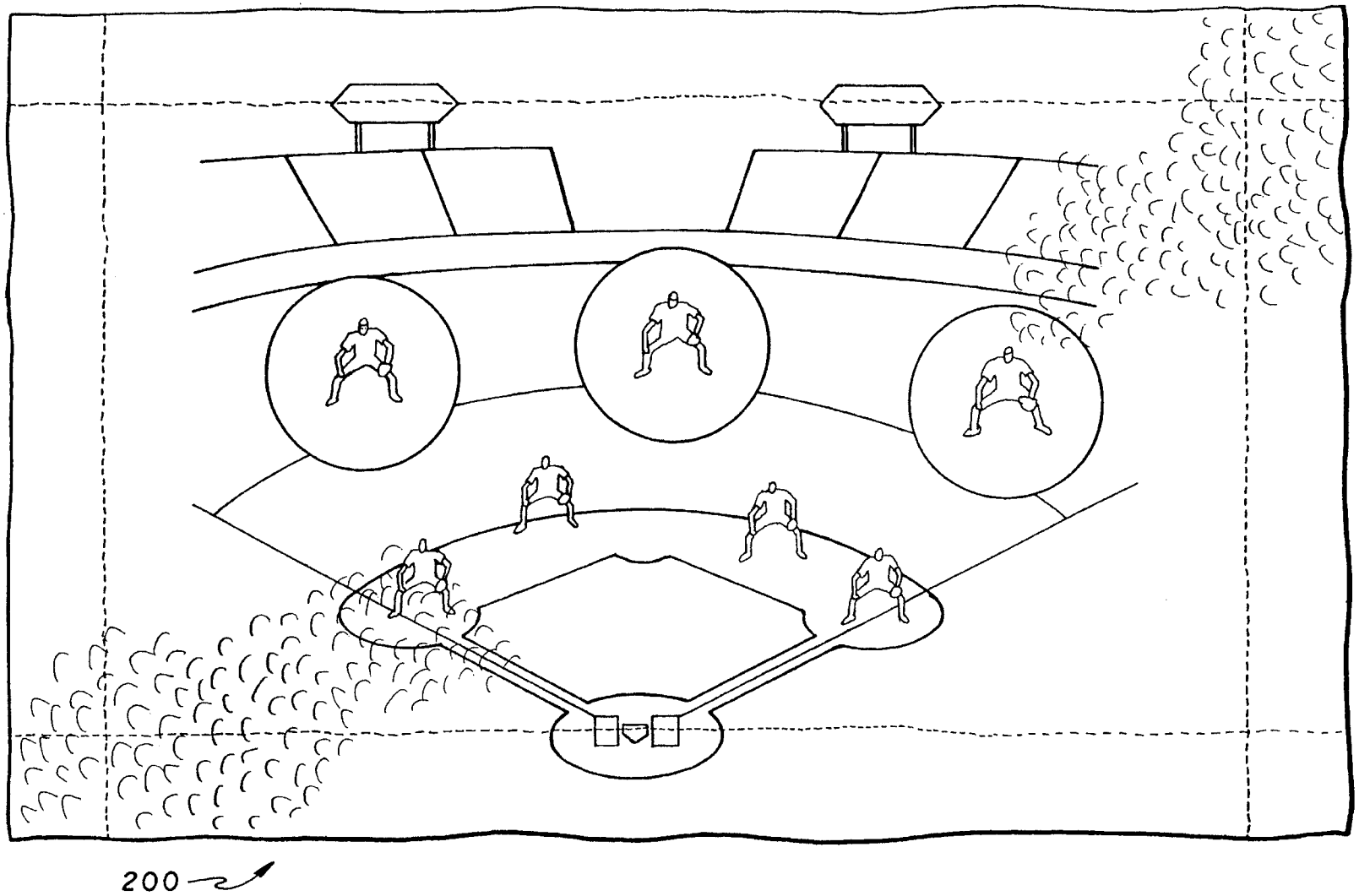
FIG. 5 is a front view of the target of the present invention, showing a baseball field design imprinted on the target.
Figure 6:
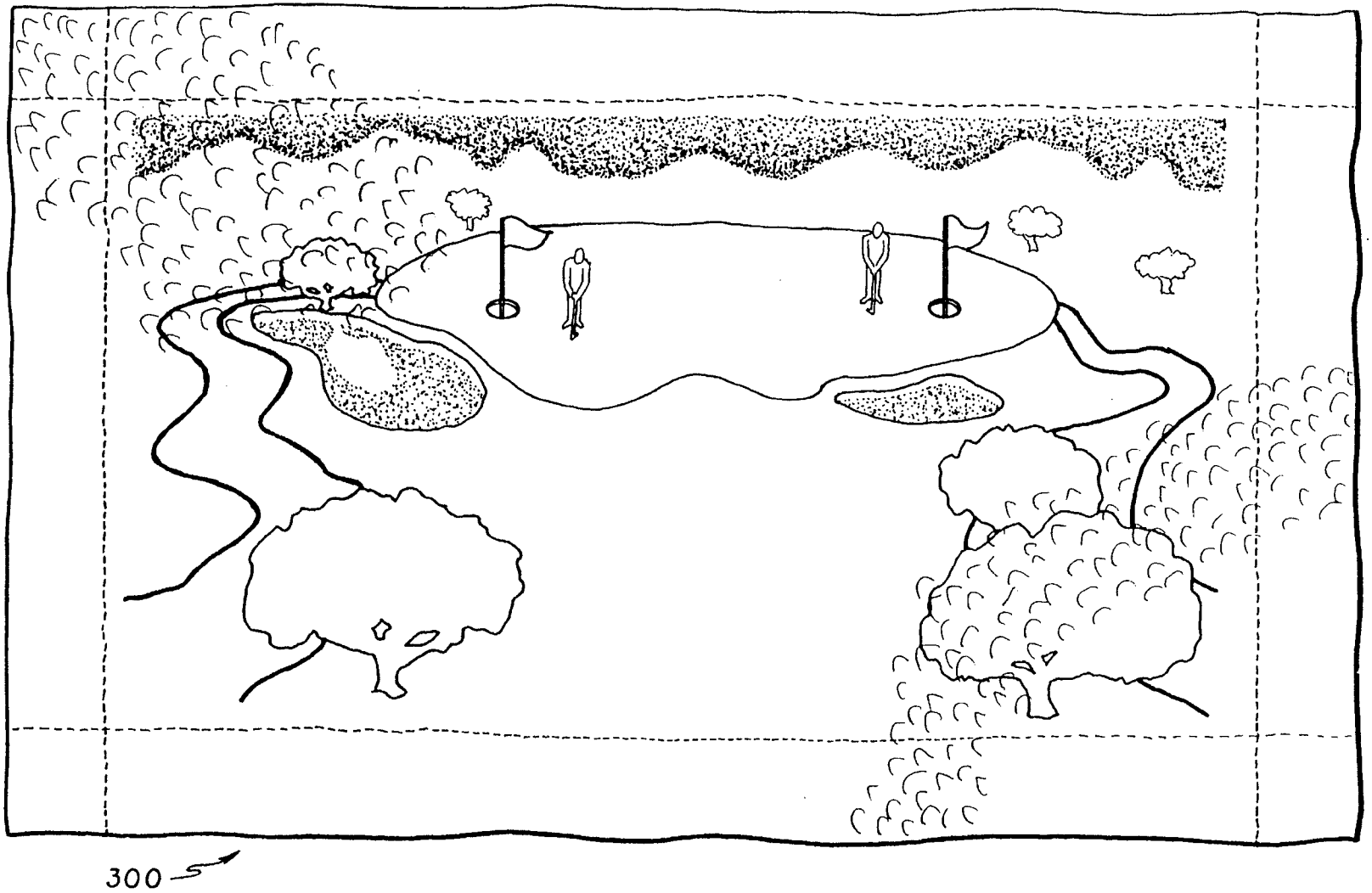
FIG. 6 is a front view of the target of the present invention, showing a golf green design imprinted on the target.

The design imprinted on the side of the target or on each side of the reversible target may take the form of a hockey goalie as shown on the target face 100 in FIG. 4, a baseball field as shown on the target face 200 in FIG. 5, a golf green as shown in the target face 300 of FIG. 6, or any sports related theme. The dual nature of the reversible target may allow different sports to be represented on the same target or a single sport with different variations of the sport to be displayed on each surface of the target.

The frame 12 to support the target is shown in FIG. 1. It is constructed of a base having three horizontal pipe shaped members connected at right angles in a "C" shape, including two members 30 which are mirror images of each other and a third member 32 which connects these members. Two identical, vertical members 34 attach to the horizontal base at right angles and are connected to each other by a fourth horizontal pipe 36, which is identical in dimension to the horizontal base member 32. A plurality of patches of hook fastening material 38, attached to the frame, mate with the loop fastening material of the reversible target so as to support the target in a vertical position. Patches 38 are preferably adhesive backed to adhere to the frame 12. All of the vertical and horizontal members are connected to each other by elbow joints 40.

It is to be understood that the present invention is not limited to the embodiments described above, but encompasses any and all embodiments within the scope of the following claims.

We claim:

1. An athletic projectile and target training apparatus, said apparatus being in the form of a kit comprising:

a sports related projectile having a first surface, said first surface including one component of hook and loop fastening material attached thereto;

a sports related target having a second surface, said second surface being covered by a second component of said hook and loop fastening material;

a frame to support said target; and a plurality of patches of one component of hook and loop fastening material attached to said frame to detachably support said target along edges thereof.

2. The athletic projectile and target training apparatus according to claim 1, said projectile being configured to resemble a hockey puck and having an exterior circumference, said first surface being said puck circumference, said target sports related marking comprising an image of a hockey goalie.

3. The athletic projectile and target training apparatus according to claim 1, said projectile being configured to resemble a baseball, said first surface being an exterior surface of said baseball configured projectile, said projectile being hollow, there further being a first patterned array of holes through said first surface, and a second patterned array of said one component of hook and loop fasteners thereon, said target sports related marking comprising an image of a baseball field.

4. The athletic projectile and target training apparatus according to claim 1, said projectile being configured to resemble a golf ball, said first surface being an exterior surface of said golf ball configured projectile, said projectile being hollow, there further being a first patterned array of holes through said first surface, and a second patterned array of said one component of hook and loop fasteners thereon, said target sports related marking comprising an image of a golf green.

5. The athletic projectile and target training device according to claim 1, wherein said frame is constructed from a plurality of pipe sections and elbow joints, said frame including:

a base having first, second, and third horizontal pipe sections connected at right angles in a "C" shape, first and second vertical pipe sections vertically attached to said base at right angles, and a fourth horizontal pipe section extending between said first and second vertical pipe sections.

6. An athletic projectile and target training apparatus in the form of a kit comprising:

first and second projectiles, each of said first and second projectiles having a respective surface, said first projectile having one component of hook and loop fastening material provided on a portion of the surface thereof, and said second projectile having one component of hook and loop fastening material provided on a portion of the surface thereof;

a target having first and second surfaces, said first surface of said target being substantially covered by a second component of hook and loop fastening material and having a first sports related marking thereon, said second surface of said target being substantially covered by said second component of hook and loop fastening material and having a second sports related marking thereon, each of said first sports related marking and said second sports related marking imprinting a respective one of said first and second surfaces of said target without impeding the said fastening material in registry with said first sports related marking and said second sports related marking from functioning in its capacity as said fastening material;

a frame to support said target; and a plurality of patches of one component of hook and loop fastening material attached to said frame to detachably support said target along edges thereof.

7. The athletic projectile and target training apparatus according to claim 6, wherein said first projectile is in the shape of a disc having a circumference and resembles a hockey puck, there being one component of hook and loop fastening material attached to the said circumference thereof, said first sports related marking including an image of a hockey goalie imprinted on said first surface of said target, said second projectile being a hollow ball having a surface, said ball being golf ball sized, said ball having a plurality of holes spaced evenly on said surface of said ball, and having a plurality of circular patches of one component of hook and loop fastening material attached to said surface of said ball, and said second sports related marking includes an image of a golf green imprinted on said second surface of said target.

8. The athletic projectile and target training apparatus according to claim 6, wherein said first projectile is in the shape of a disc having a circumference and resembles a hockey puck, there being one component of hook and loop fastening material attached to the said circumference thereof, said first sports related marking including an image of a hockey goalie imprinted on said first surface of said target, said second projectile being a hollow ball having a surface, said ball being baseball sized, said ball having a plurality of holes spaced evenly on said surface of said ball, and having a plurality of circular patches of one component of hook and loop fastening material attached to said surface of said ball, and said second sports related marking including an image of a baseball field imprinted on said second surface of said target.

9. The athletic projectile and target training apparatus according to claim 6, wherein said first projectile is a hollow ball having a surface, said ball being golf ball sized, said first projectile having a plurality of holes spaced evenly on said surface of said first projectile, and having a plurality of circular patches of one component of hook and loop fastening material attached to said surface of said first projectile, said first sports related marking includes an image of a golf green imprinted on said first surface of said target, said second projectile being a hollow ball having a surface, said second projectile being baseball sized, said second projectile having a plurality of holes spaced evenly on said surface of said second projectile, and having a plurality of circular patches of one component of hook and loop fastening material attached to said surface of said second projectile, and said second sports related marking includes an image of a baseball field imprinted on said second surface of said target.

10. The athletic projectile and target training apparatus according to claim 6, wherein said first projectile is in the shape of a disc having a circumference and resembles a hockey puck, there being one component of hook and loop fastening material attached to the said circumference thereof, said first sports related marking including a first image of a hockey goalie imprinted on said first surface of said target, said second projectile being in the shape of a disc having a circumference and resembling a hockey puck, there being one component of hook and loop fastening material attached to the circumference thereof, said second sports related marking includes a second image of a hockey goalie, different from said first image on said first surface of said target, imprinted on said second surface of said target.

11. The athletic projectile and target training apparatus according to claim 6, wherein said first projectile is a hollow ball having a surface, said ball being the size of a golf ball, said first projectile having a plurality of holes spaced evenly on said surface of said first projectile, and having a plurality of circular patches of one component of hook and loop fastening material attached to said surface of said first projectile, said first sports related marking includes a first image of a golf green imprinted on said first surface of said target, said second projectile being a hollow ball having a surface, said ball being the size of a golf ball, said second projectile having a plurality of holes spaced evenly on said surface of said second projectile, and having a plurality of circular patches of one component of hook and loop fastening material attached to said surface of said second projectile, said second sports related marking including a second image of a golf green, different from said first image of a golf green on said first surface of said target, imprinted on said second surface of said target.

12. The athletic projectile and target training apparatus according to claim 6, wherein said first projectile is a hollow ball having a surface, said ball being the size of a baseball, said first projectile having a plurality of holes spaced evenly on said surface of said first projectile, and having a plurality of circular patches of one component of hook and loop fastening material attached to said surface of said first projectile, said first sports related marking including a first image of a baseball field imprinted on said first surface of said target, said second projectile being a hollow ball having a surface, said ball being baseball sized, said ball having a plurality of holes spaced evenly on said surface of said ball, and having a plurality of circular patches of one component of hook and loop fastening material attached to said surface of said ball, and said second sports related marking includes a second image of a baseball field, different from said first image of said baseball field on said first surface of said target, imprinted on said second surface of said reversible target.

13. The athletic projectile and target training apparatus according to claim 6, wherein said frame is constructed from a plurality of pipe sections and elbow joints, said frame including:

a base having first, second, and third horizontal pipe sections connected at right angles in a "C" shape, first and second vertical pipe sections vertically attached to said base at right angles, and a fourth horizontal pipe section extending between said first and second vertical pipe sections.

14. The athletic projectile and target training apparatus according to claim 6, wherein said first and second surfaces of said target have three layers comprising a nylon loop fastening material, a polyester foam core, and a back panel of nylon tricot;

said first surface having a smaller dimension than said second surface, such that said first and said second surfaces can be placed back-to-back, with said second surface folded over and engulfing the edges of said first surface; and said first surface and second surface including means for securely attaching said surfaces to each other.

15. The athletic projectile and target training apparatus according to claim 13, wherein said plurality of patches of one component of hook and loop fastening material are attached to said fourth horizontal pipe section and said first and second vertical pipe sections to support said target along edges thereof, whereby said target can be detachably secured to said frame.

16. The athletic projectile and target training apparatus according to claim 15, wherein said target surface is folded over and secured to form a plurality of folds, whereby said folds being covered by one component of said hook and loop fastening material for detachably securing to the plurality of patches of said second component of hook and loop fastening material attached to said fourth horizontal pipe section and said first and second vertical pipe sections in order to support said target against said frame.

* * * * *